US012805633B1

(12) United States Patent
Song

(10) Patent No.: US 12,805,633 B1
(45) Date of Patent: Nov. 24, 2026

(54) FOLDABLE STORAGE BOX AND BOX SET

(71) Applicant: Guangdong Haixing Plastic & Rubber Co., Ltd., Jieyang (CN)

(72) Inventor: Xubin Song, Jieyang (CN)

(73) Assignee: Guangdong Haixing Plastic & Rubber Co., Ltd., Jieyang (CN)

( * ) Notice: Subject to any disclaimer, the term of this patent is extended or adjusted under 35 U.S.C. 154(b) by 0 days.

(21) Appl. No.: 19/661,805

(22) Filed: Apr. 29, 2026

(30) Foreign Application Priority Data

Sep. 10, 2025 (CN) ..... 202521953790.5

(51) Int. Cl.

| | |
|---|---|
| ***A47B 88/90*** | (2017.01) |
| ***A47B 43/00*** | (2006.01) |
| ***A47B 45/00*** | (2006.01) |
| ***A47B 87/02*** | (2006.01) |

(52) U.S. Cl.
CPC ..... *A47B 88/9412* (2017.01); *A47B 43/00* (2013.01); *A47B 45/00* (2013.01); *A47B 87/0276* (2013.01); *A47B 2220/0002* (2013.01)

(58) Field of Classification Search
CPC ..... A47B 43/00; A47B 45/00; A47B 47/047; A47B 87/0276
See application file for complete search history.

(56) References Cited

U.S. PATENT DOCUMENTS

| | | | | |
|---|---|---|---|---|
| 2005/0174019 | A1* | 8/2005 | Chi-Sheng | A47B 67/04 312/258 |
| 2008/0218041 | A1* | 9/2008 | Chiang | A47B 88/9412 312/258 |
| 2015/0041420 | A1* | 2/2015 | Zelek | A47F 5/10 211/195 |
| 2021/0339905 | A1* | 11/2021 | Darkwah | E05B 65/52 |
| 2024/0298791 | A1* | 9/2024 | Trollope | A47B 43/00 |
| 2025/0294700 | A1* | 9/2025 | Hirao | A47B 43/00 |
| 2026/0150962 | A1* | 6/2026 | Bao | A47B 43/00 |

* cited by examiner

*Primary Examiner* — Daniel J Rohrhoff

(57) ABSTRACT

The disclosure discloses a foldable storage box and a box set. It includes a bottom panel, a top panel, a drawable panel, a door panel assembly, a back panel, and at least two side panel assemblies. The drawable panel is connected to the bottom panel and movable in a front-rear direction relative to the bottom panel. In the unfolded state, a first storage space is formed between the top panel and the bottom panel, and the side panel assemblies, the door panel assembly, and the back panel constitute sidewalls of the first storage space. In the folded state, a second storage space is formed between the top panel and the bottom panel, the side panel assemblies are rotated into the second storage space and folded therein, and the door panel assembly and the back panel are respectively rotated into the second storage space.

18 Claims, 11 Drawing Sheets

FOLDABLE STORAGE BOX AND BOX SET

CROSS-REFERENCE TO PRIOR APPLICATION

This application claims priority to Chinese Patent Application No. 202521953790.5 filed with the China National Intellectual Property Administration on Sep. 10, 2025, which is incorporated herein by reference in its entirety.

TECHNICAL FIELD

The disclosure relates to the technical field of storage boxes, more particularly to a foldable storage box and a box set.

BACKGROUND

Storage boxes that define independent enclosed spaces are commonly used household tools for storing items such as clothing, shoes, books, and documents. The pull-out type storage boxes have a structure for supporting items, which is drawable out to facilitate easy access for users. However, conventional pull-out type storage boxes have a non-foldable drawer structure and are inconvenient to store. During transportation, they take up relatively large space and are prone to damage due to collision. In related technology, the pull-out type storage boxes are disassembled into several panels, requiring users to assemble them piece by piece into a complete storage box after receipt. The assembly actions are simple but highly repetitive. The more storage boxes, the longer the assembly time. If users subsequently need to store and transport the storage boxes due to reasons such as moving, they have to disassemble them. Then, when they need to use them again, they have to repeat the assembly steps, which is a tedious and time-consuming process. Besides, the disassembled storage boxes are prone to losing some panels or components, rendering them unusable.

SUMMARY

The disclosure is to provide a foldable storage box which is entirely foldable to facilitate storage and transportation and avoids the loss of components during storage and transportation.

In order to achieve the above goal, the disclosure provides a foldable storage box having an unfolded state and a folded state. The foldable storage box includes:

A bottom panel and a top panel;

A drawable panel arranged on a side of the bottom panel facing the top panel; The drawable panel being connected to the bottom panel and movable in a front-rear direction relative to the bottom panel;

At least two side panel assemblies, each of which has a top end pivotally connected to the top panel and a bottom end pivotally connected to the bottom panel, and is foldable in such a manner that the top end and the bottom end thereof get closer to each other;

A door panel assembly pivotally connected to the top panel;

A back panel pivotally connected to the top panel; with the side panel assembly, the door panel assembly, and the back panel extending along a perimeter of the top panel;

In the unfolded state, the door panel assembly and the back panel respectively abut against the bottom panel to support the top panel, a first storage space is formed between the top panel and the bottom panel, and the side panel assemblies, the door panel assembly, and the back panel constitute sidewalls of the first storage space;

In the folded state, the top panel abuts on the bottom panel, a second storage space is formed between the top panel and the bottom panel, the side panel assemblies are rotated into the second storage space and folded therein, and the door panel assembly and the back panel are respectively rotated into the second storage space.

In an embodiment of the disclosure, an underside of the top panel may be provided with a first connecting portion and a second connecting portion.

In the folded state, the door panel assembly may be connected to the first connecting portion to limit a position of the door panel assembly in an up-down direction, and the back panel may be connected to the second connecting portion to limit a position of the back panel in the up-down direction.

In an embodiment of the disclosure, the first connecting portion may be provided with a fixing groove that extends in the front-rear direction, and, in the folded state, the door panel assembly may be located in the fixing groove.

In an embodiment of the disclosure, the underside of the top panel may be provided with a first surrounding panel extending along the perimeter of the top panel, the first connecting portion may be located on an inner side of the first surrounding panel, and, in the folded state, the first surrounding panel may at least form a portion of a side wall of the second storage space.

In an embodiment of the disclosure, the back panel may be provided with a third connecting portion, and, in the folded state, the third connecting portion may be connected to the second connecting portion.

In an embodiment of the disclosure, the first connecting portion and the second connecting portion may be staggered along the up-down direction, such that the door panel assembly and the back panel are staggered along the up-down direction in the folded state.

In an embodiment of the disclosure, the side panel assemblies may each include at least two sub-panels that are sequentially pivotally connected;

The sub-panel at its top end may be a first sub-panel pivotally connected to the top panel, and the sub-panel at its bottom end may be a second sub-panel pivotally connected to the bottom panel; and, in the folded state, both the first sub-panel and the second sub-panel may be pivotable into the second storage space.

In an embodiment of the disclosure, the door panel assembly may include a door frame, a first door panel, and a second door panel, wherein the door frame may be pivotally connected to the top panel, the first door panel and the second door panel may be arranged in the door frame along a left-right direction, both the first door panel and the second door panel may be pivotally connected to the door frame, with both a rotation axis of the first door panel relative to the door frame and a rotation axis of the second door panel relative to the door frame extending in an up-down direction.

In an embodiment of the disclosure, one of a top side of the top panel and an underside of the bottom panel may be provided with a limiting protrusion, the other one may be provided with a limiting groove, and the limiting protrusion may fit with the limiting groove.

The disclosure further provides a box set, including at least two foldable storage boxes as mentioned above, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

Compared with the prior art, the foldable storage box and the box set according to the embodiments of the disclosure have advantages as follows.

The foldable storage box according to the embodiment of the disclosure utilizes the drawable panel to hold items, avoiding interference with the top panel and the bottom panel. Moreover, the top panel and the bottom panel can be brought closer to each other to reduce the height of the foldable storage box, thereby facilitating storage. The side panel assemblies are respectively pivotally connected to the top panel and the bottom panel and thus are foldable. The door panel assembly and the back panel are respectively pivotally connected to the top panel. In this way, the foldable storage box is configured to fold and unfold via the pivoting and folding of the side panel assemblies and the pivoting of the door panel assembly and the back panel, thereby saving assembly steps, maintaining the connections between various components of the folded storage box, and avoiding the loss of components during transportation or after prolonged periods of non-use. In addition, when the foldable storage box is in the folded state, the second storage space is formed between the bottom panel and the top panel, accommodating the drawable panel, the door panel assembly, the back panel, and the side panel assemblies. It serves to accommodate and protect them, preventing them from being squeezed and damaged, and ensuring a neat appearance of the folded storage box for easy transportation.

REFERENCE SIGNS

Figure 1:
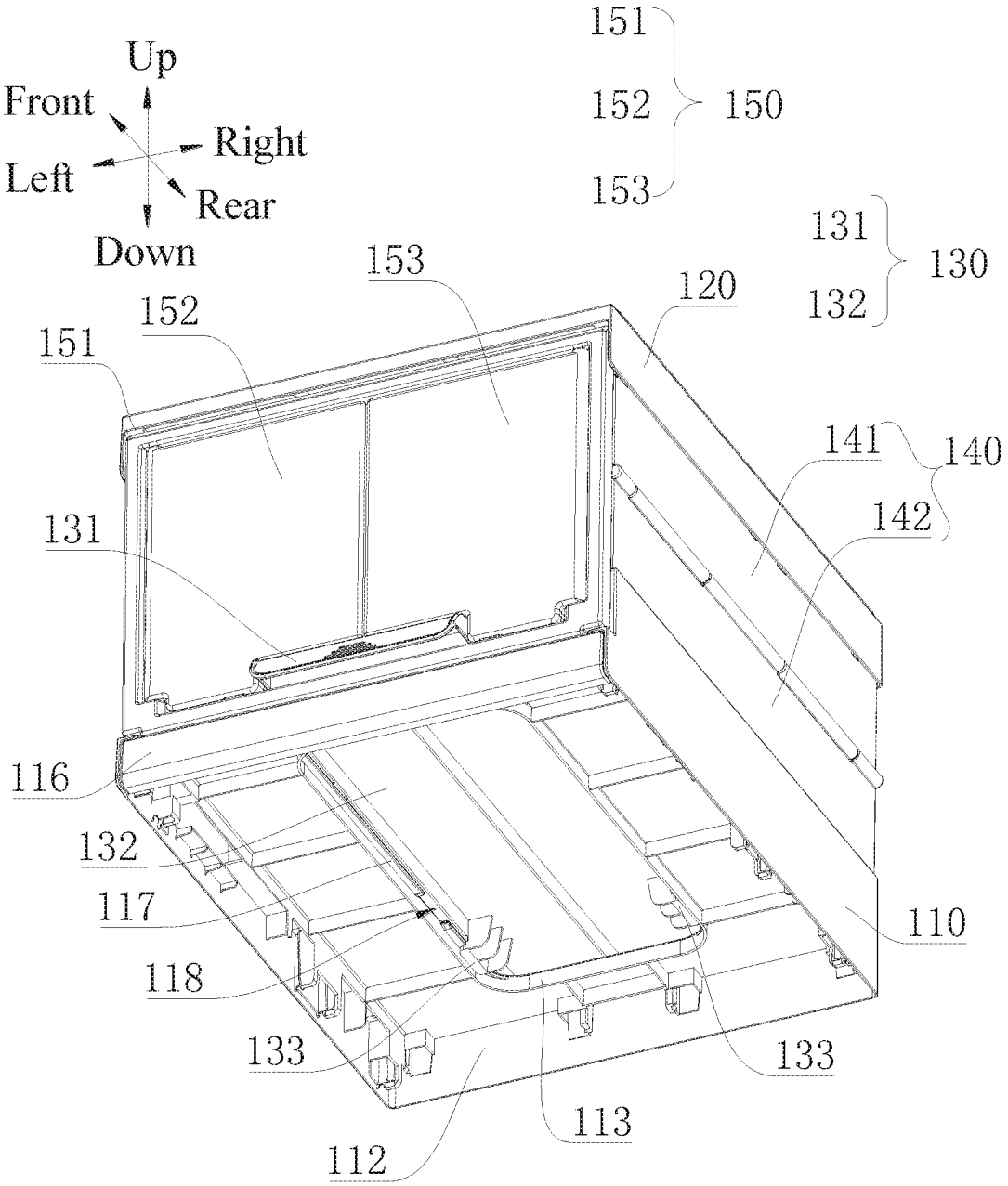
FIG. 1 is a first perspective view of a foldable storage box according to an embodiment of the disclosure.

100. foldable storage box;

110. bottom panel; 111. first storage space; 112. limiting groove; 113. mounting hole; 114. second surrounding panel; 115. second storage space; 116. blocking bar; 117. limiting bar; 118. mounting notch;

120. top panel; 121. first surrounding panel; 122. first connecting portion; 1221. upper rib plate; 1222. lower rib plate; 1223. reinforcing rib; 123. fixing groove; 124. second connecting portion; 125. limiting protrusion; 126. snap-fit element;

130. drawable panel; 131. handle; 132. panel body; 133. limiting member;

140. side panel assembly; 141. first sub-panel; 142. second sub-panel;

150. door panel assembly; 151. door frame; 1511. connecting head; 152. first door panel; 153. second door panel;

160. back panel; 161. third connecting portion; 170. connecting panel.

DETAILED DESCRIPTION OF ILLUSTRATED EMBODIMENTS

The embodiments of the disclosure will be further explained below in detail with reference to drawings and implementations. The following implementations serve to illustrate the disclosure, but are not intended to limit the disclosure.

The terms, such as "center", "longitudinal", "transverse", "up", "down", "front", "rear", "left", "right", "vertical", "horizontal", "top", "bottom", "inner", and "outer" as used in the description of embodiments, refer to position and orientation relationships as shown in the drawings or in accordance for convenience of description and for the purpose of simplicity. They are not intended to indicate or imply a limitation in terms of specific orientation or configuration and operation with specific orientation to the described device or element, and should not be construed as a limitation on the disclosure. Besides, the terms "first", "second", and "third" are used for the purpose of description and are not intended to indicate or imply relative importance.

Unless defined or specified otherwise, the terms such as "connect" and "attach" as used in the description of embodiments are intended to have meanings commonly understood in a broad sense. The meanings of the terms used herein may be understood by those skilled in the art in accordance with specific conditions.

The terms such as "an embodiment", "some embodiments", "an implementation", "a particular implementation", and "some implementations" as used in the description refer to specific features, structures, materials, or characteristics related to the embodiments or implementations that are included in at least one embodiment or implementation of the disclosure. In the specification, the exemplary description for the foregoing terms does not necessarily refer to the same embodiment or implementation. Furthermore, the described specific features, structures, materials, or characteristics may be combined in one or more embodiments or implementations in any appropriate manner. Moreover, those skilled in the art may incorporate and combine different embodiments or implementations and features of the different embodiments or implementations described in the specification without contradictions.

It should be noted that, for ease of illustration, the side of the foldable storage box that faces the user during normal and general use is referred to as the front side, and the opposite side is referred to as the rear side. The left and right sides are determined based on the user's orientation when facing the foldable storage box. The top and bottom sides are determined according to the upper and lower sides of the foldable storage box during normal and general use.

Figure 2:
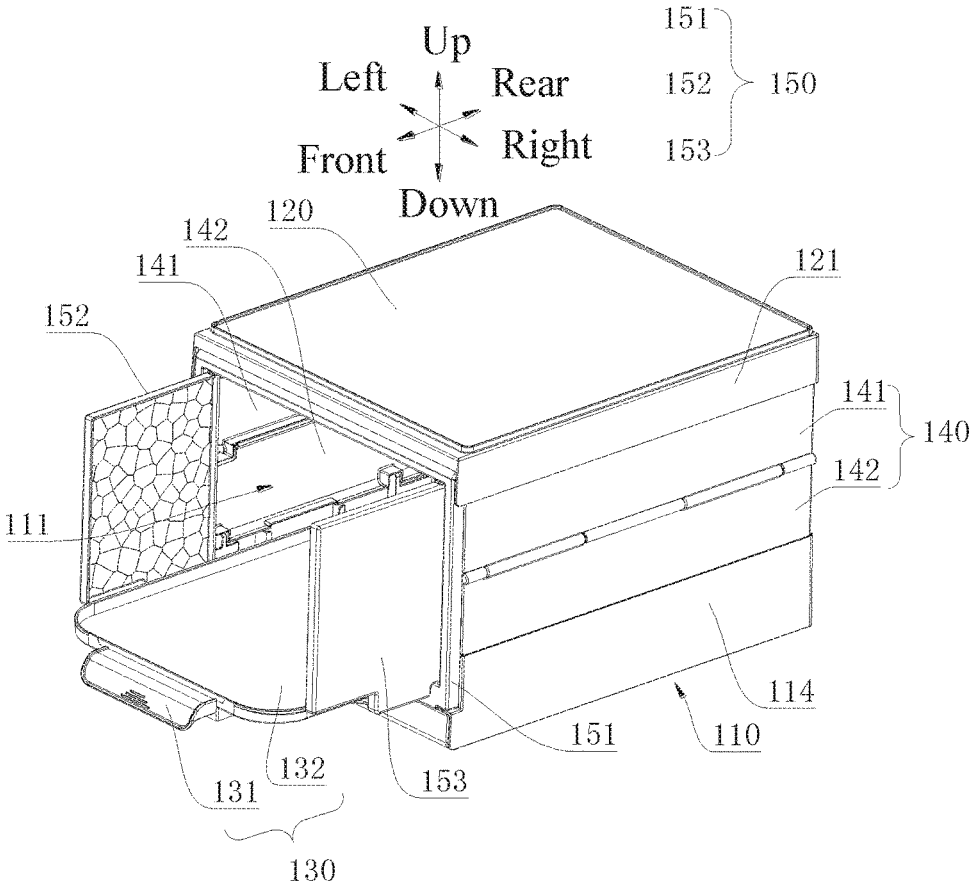
FIG. 2 is a second perspective view of a foldable storage box according to an embodiment of the disclosure.
Figure 3:
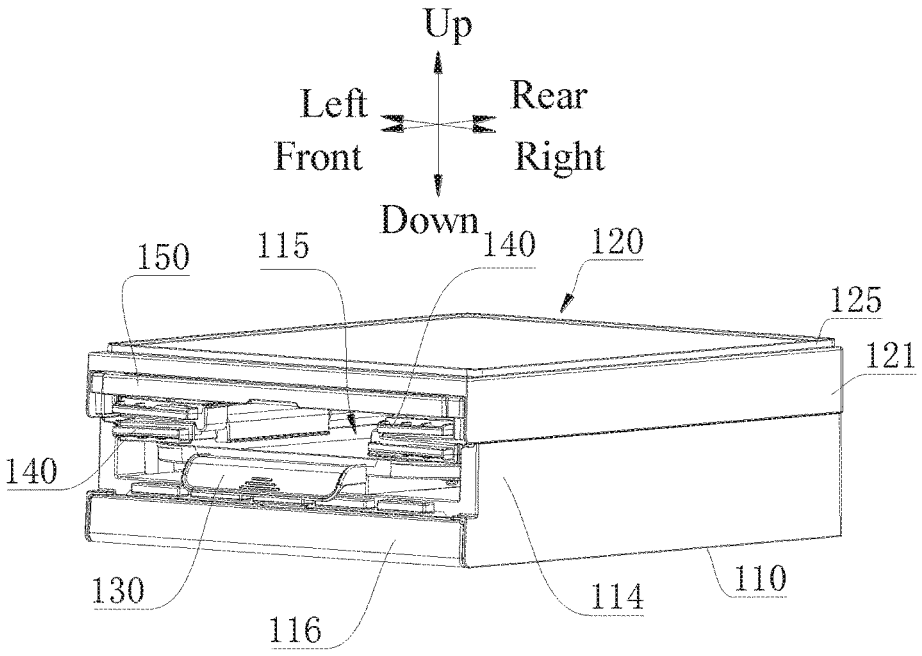
FIG. 3 is a schematic structural view of a foldable storage box according to an embodiment of the disclosure, in which the foldable storage box is in a folded state.

Referring to FIGS. 1-3, in the foldable storage box 100 according to an embodiment of the disclosure, the foldable storage box 100 has a folded state and an unfolded state. The foldable storage box 100 includes a bottom panel 110, a top panel 120, a drawable panel 130, a door panel assembly 150, a back panel 160, and at least two side panel assemblies 140.

Specifically, the top panel 120 and the bottom panel 110 are arranged opposite each other. The drawable panel 130 is arranged on the side of the bottom panel 110 facing the top panel 120, and is connected to the bottom panel 110 and is movable in the front-rear direction relative to the bottom panel 110. For example, referring to FIG. 1, the bottom panel 110 is provided with a mounting hole 113 extending in the front-rear direction. The sidewall of the mounting hole 113 that extend in the front-rear direction is provided with a limiting bar 117, and the limiting bar 117 is provided with a mounting notch 118. The bottom side of the drawable panel 130 is provided with a limiting member 133 that is L-shaped. One end of the limiting member 133 is connected to the bottom surface of the drawable panel 130 to form a U-shaped limiting groove between the limiting member 133 and the bottom surface of the drawable panel 130. The end of the limiting member 133 that is away from the drawable panel 130 can move from the upper side of the bottom panel to its lower side through the mounting notch 118, allowing the limiting bar 117 to fit into the limiting groove and connecting the drawable panel 130 to the bottom panel 110. During the movement of the drawable panel 130 in the front-rear direction relative to the bottom panel 110, the limiting groove slides along the limiting bar 117 to restrict the position of the drawable panel. To disassemble the drawable panel 130 from the bottom panel 110, the drawable panel 130 can be moved relative to the bottom panel 110 to a position where the limiting member 133 corresponds to the mounting notch 118. Then, the drawable panel 130 can be moved upward such that the end of the limiting member 133 that is away from the drawable panel 130 is moved upward through the mounting notch 118 and separated from the limiting bar 117.

The top ends of the side panel assemblies 140 are pivotally connected to the top panel 120, and the bottom ends of the side panel assemblies 140 are pivotally connected to the bottom panel 110. The side panel assemblies 140 can be folded such that their top and bottom ends get closer to each other. The door panel assembly 150 is pivotally connected to the top panel 120, and the back panel 160 is pivotally connected to the top panel 120. The side panel assemblies 140, the door panel assembly 150, and the back panel 160 are arranged around the top panel, with the door panel assembly 150 located at the front side of the top panel 120, the back panel 160 located at the rear side of the top panel 120, the side panel assemblies 140 located between the door panel assembly 150 and the back panel 160, at least one side panel assembly 140 positioned on the left side of the top panel 120, and at least one side panel assembly 140 positioned on the right side of the top panel 120.

When the foldable storage box 100 is in the unfolded state, the door panel assembly 150 and the back panel 160 respectively abut against the bottom panel 110 to support the top panel 120. A first storage space 111 is formed between the top panel 120 and the bottom panel 110, and the side panel assemblies 140, the door panel assembly 150, and the back panel 160 constitute the sidewalls of the first storage space 111. In some embodiments, when the foldable storage box 100 is in the unfolded state, the door panel assembly 150 is connected to the side panel assemblies 140 that are unfolded, to secure the side panel assemblies 140 and prevent them from folding during use. For example, the door panel assembly 150 and the side panel assemblies 140 may be connected via snap-fit connections.

When the foldable storage box 100 is in the folded state, the top panel 120 abuts on the bottom panel 110, and a second storage space 115 is formed therebetween. The side panel assemblies 140 are rotated into the second storage space 115 and folded therein. The door panel assembly 150 and the back panel 160 are respectively rotated into the second storage space 115. In this way, the foldable storage box 100 has a reduced height and is convenient for storage and transportation. Moreover, in the folded state, the side panel assemblies 140, the door panel assembly 150, the back panel 160, and the drawable panel 130 can all be accommodated in the second storage space 115, avoiding the loss of any components of the foldable storage box 100.

Referring to FIG. 1, where the foldable storage box 100 is in the unfolded state, the drawable panel 130 can carry items. The drawable panel 130 includes the panel body 132 and the handle 131. Users can move the drawable panel 130 relative to the bottom panel 110 via the handle 131. In the example shown in FIG. 1, the panel body 132 is entirely located in the first storage space 111 and constitutes the bottom of the first storage space 111, with the handle 131 at least partially positioned outside the storage space 111. Referring to FIG. 2, where the foldable storage box 100 is in the unfolded state, the drawable panel 130 is moved forward relative to the bottom panel 110, away from the first storage space 111, such that the panel body 132 is partially positioned outside the first storage space 111, thereby carrying items out of it to facilitate easy retrieval by users. Compared to existing storage boxes with drawer structures, the drawable panel 130 has a smaller thickness and occupies less space, enabling the top panel 120 and the bottom panel 110 to get closer to each other, thereby reducing the height of the foldable storage box 100 to facilitate storage.

Each of the side panel assemblies 140 has an upper end pivotally connected to the top panel 120 and a lower end pivotally connected to the bottom panel 110. This allows the side panel assemblies 140 to be folded through relative rotation between the sub-panels and between the sub-panels and the top and bottom panels 120, 110, thereby bringing the bottom panel 110 and the top panel 120 closer together and thus compressing the foldable storage box 100. The sub-panels of the side panel assemblies 140 connected to the top panel 120 are the first sub-panels 141, and the sub-panels connected to the bottom panel 110 are the second sub-panels 142.

The side panel assemblies 140, the door panel assembly 150, and the back panel 160 are arranged around the storage space 111. When the foldable storage box 100 is in the unfolded state, the side panel assemblies 140, the door panel assembly 150, and the back panel 160 constitute the sidewalls of the first storage space 111, with the back panel 160 and the door panel assembly 150 arranged opposite each other. For example, the door panel assembly 150 is arranged at the front side of the storage space 111, and the back panel 160 is arranged at the rear side of the storage space 111. When the foldable storage box 100 is in the unfolded state, the bottom end of the door panel assembly 150 abuts against the bottom panel 110, and the bottom end of the back panel 160 abuts against the bottom panel 110, providing stable support for the top panel 120 and the bottom panel 110 to define the first storage space 111. When the foldable storage box 100 is in the folded state, the second storage space 115 is formed between the bottom panel 110 and the top panel 120, to accommodate the drawable panel 130, the door panel assembly 150, the back panel 160, and the side panel assemblies 140. The door panel assembly 150, the back panel 160, and the side panel assemblies 140 all remain connected to the top panel 120 and are pivotable relative to it to be accommodated in the second storage space 115. The bottom panel 110 and the top panel 120 remain connected via the side panel assemblies 140, preventing the loss of components during folding, storage, and transportation of the foldable storage box 100. Moreover, the second storage space 115 serves to accommodate the drawable panel 130, the door panel assembly 150, the back panel 160, and the side panel assemblies 140, and protect them from being squeezed and damaged.

The foldable storage box 100 according to the embodiment of the disclosure utilizes the drawable panel 130 to hold items, avoiding interference with the top panel 120 and the bottom panel 110. Moreover, the top panel 120 and the bottom panel 110 can be brought closer to each other to reduce the height of the foldable storage box 100, thereby facilitating storage. The side panel assemblies 140 are respectively pivotally connected to the top panel 120 and the bottom panel 110 and thus are foldable. The door panel assembly 150 and the back panel 160 are respectively pivotally connected to the top panel 120. In this way, the foldable storage box 100 is configured to fold and unfold via the pivoting and folding of the side panel assemblies 140 and the pivoting of the door panel assembly 150 and the back panel 160, thereby saving assembly steps, maintaining the connections between various components of the folded storage box 100, and avoiding the loss of components during transportation or after prolonged periods of non-use. In addition, when the foldable storage box 100 is in the folded state, the second storage space 115 is formed between the bottom panel 110 and the top panel 120, accommodating the drawable panel 130, the door panel assembly 150, the back panel 160, and the side panel assemblies 140. It serves to accommodate and protect them, preventing them from being squeezed and damaged, and ensuring a neat appearance of the folded storage box 100 for easy transportation.

In some embodiments, each side panel assembly 140 includes at least two sub-panels that are sequentially pivotally connected. The one at the top end of the side panel assembly 140 is the first sub-panel 141, which is pivotally connected to the top panel 120. The one at the bottom end of the side panel assembly 140 is the second sub-panel 142, which is pivotally connected to the bottom panel 110. Both the first sub-panel 141 and the second sub-panel 142 are pivotable towards the space between the top panel 120 and the bottom panel 110 to fold the side panel assembly 140. Consequently, this allows the side panel assemblies 140 to be folded through relative rotation between the sub-panels and between the sub-panels and the top and bottom panels 120, 110, thereby bringing the bottom panel 110 and the top panel 120 closer together and thus compressing the foldable storage box 100. In the folded state, both the first sub-panel 141 and the second sub-panel 142 are pivoted into the second storage space.

Figure 6:
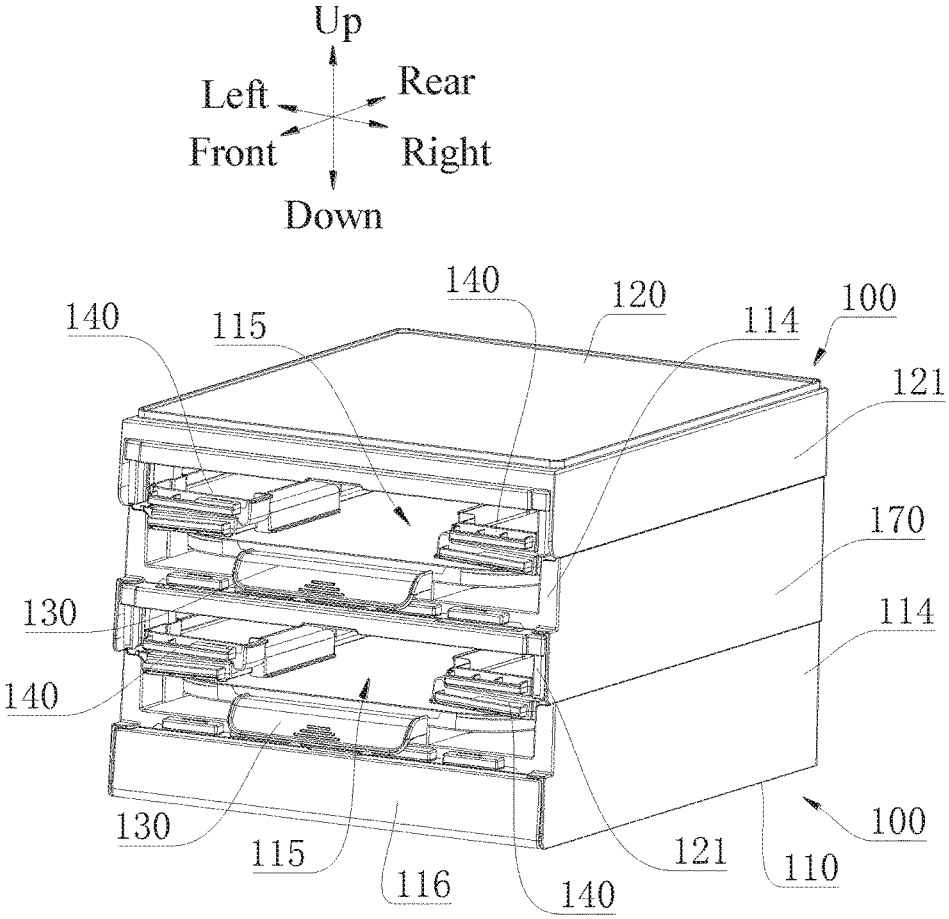
FIG. 6 is a second schematic structural view of a box set according to an embodiment of the disclosure, in which the foldable storage boxes are in a folded state.
Figure 7:
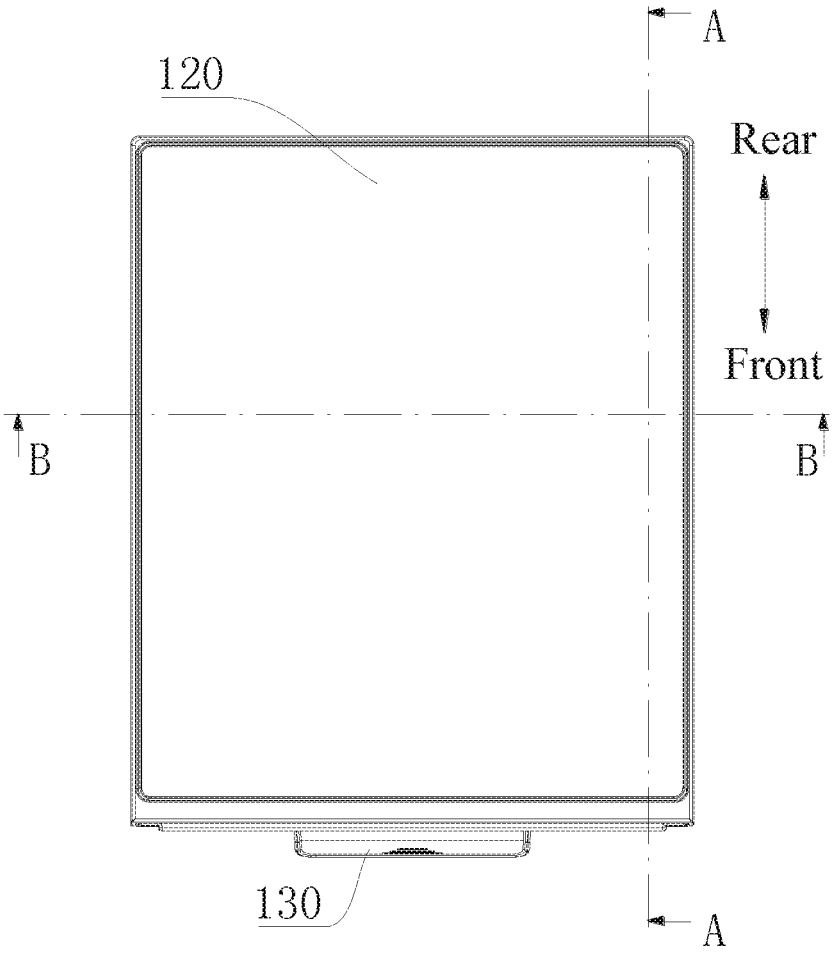
FIG. 7 is a top view of a box set according to an embodiment of the disclosure.
Figure 11:
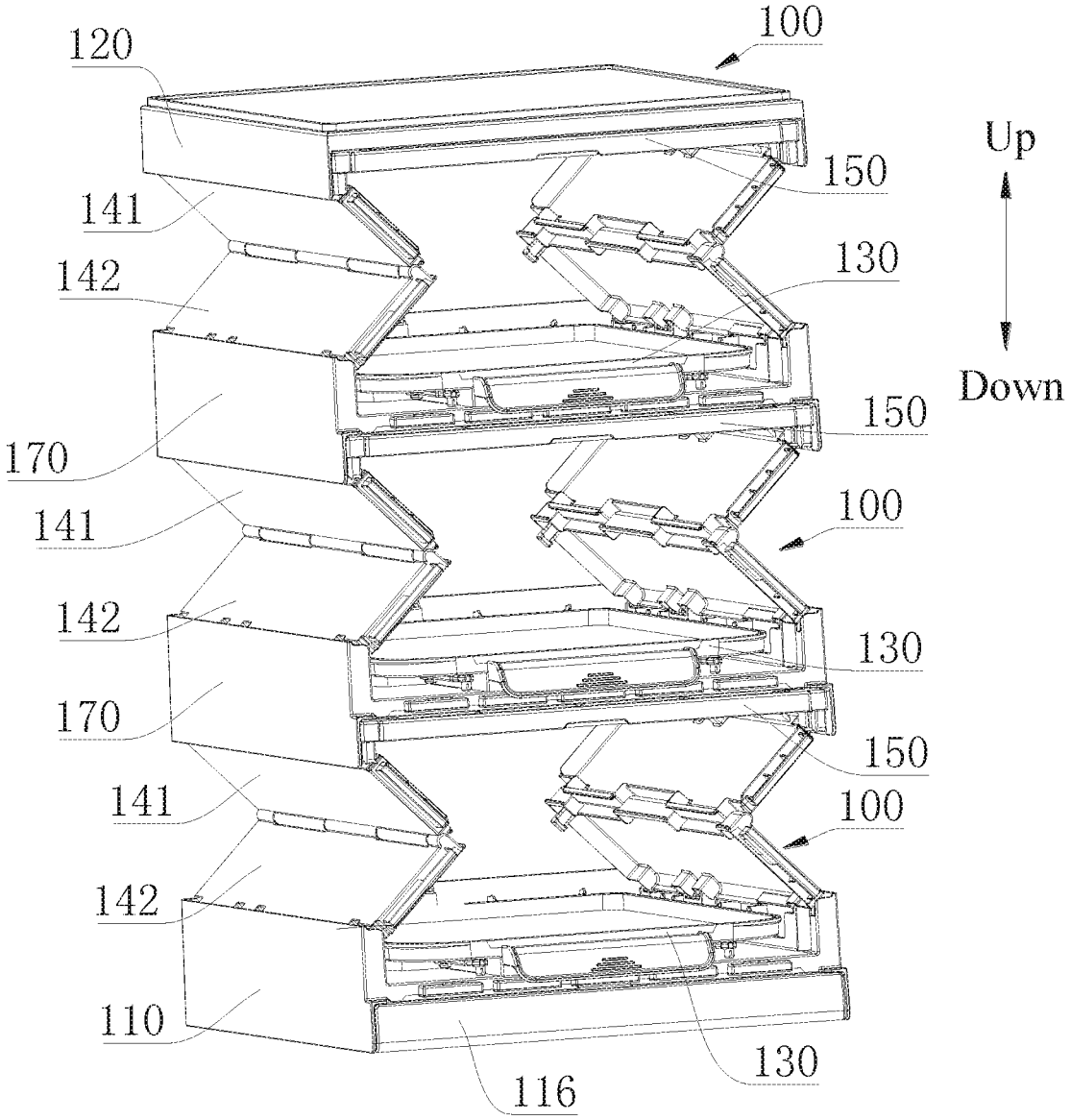
FIG. 11 is a third schematic structural view illustrating a box set according to an embodiment of the disclosure in the process of being folded.

Referring to FIG. 2, taking the side panel assembly 140 including two sub-panels as an example, the first sub-panel 141 is located above the second sub-panel 142. The first sub-panel 141 is pivotally connected to the top panel 120 with the rotation axis extending along the front-rear direction. The second sub-panel 142 is pivotally connected to the bottom panel 110 with the rotation axis extending horizontally. The first sub-panel 141 is pivotally connected to the second sub-panel 142 with the rotation axis extending horizontally. Referring to FIG. 11, the foldable storage box 100 as shown is in the process of being folded. When the foldable storage box 100 is being folded, both the first sub-panel 141 and the second sub-panel 142 rotate into the storage space 111, bringing the top panel 120 and the bottom panel 110 closer together and reducing the height of the storage space 111. Referring to FIGS. 3 and 6, the foldable storage box 100 as shown is in the folded state, with the side panel assemblies 140 accommodated in the storage space 111. The sub-panels can be pivotally connected to the top and bottom panels 120, 110 via hinges or pivot shafts, and the sub-panels can be pivotally connected to each other via hinges or pivot shafts.

In some embodiments of the disclosure, the underside of the top panel 120 is provided with a first connecting portion 122 and a second connecting portion 124. When the foldable storage box 100 is in the folded state, the door panel assembly 150 is connected to the first connecting portion 122 such that the position of the door panel assembly 150 in the up-down direction can be limited, and the back panel 160 is connected to the second connecting portion 124 such that the position of the back panel 160 in the up-down direction can be limited. On one hand, during the folding or unfolding of the foldable storage box 100, the position of the door panel assembly 150 is limited by the first connecting portion 122, and the position of the back panel 160 is limited by the second connecting portion 124, preventing the door panel assembly 150 and the back panel 160 from flipping downward to obstruct operations. On the other hand, in the folded state, the door panel assembly 150 and the back panel 160 can be prevented from flipping or falling downward to squeeze the drawable panel 130 and the side panel assemblies 140. Referring to FIG. 11, the foldable storage box 100 as shown is in the process of being folded, with the door panel assembly 150 connected to the first connecting portion 122 and with the back panel 160 connected to the second connecting portion 124. Thus, during the process of being folded, the positions of the door panel assembly 150 and the back panel 160 in the up-down direction can be limited.

Specifically, the door panel assembly 150 is pivotally connected to the top panel 120. When the foldable storage box 100 is being folded, the door panel assembly 150 moves relative to the top panel 120 to a first position. At the first position, the bottom end of the door panel assembly 150 is proximal to the top panel 120, and the door panel assembly 150 is connected to the first connecting portion 122. For example, the first connecting portion 122 may be a snap-fit, and the door panel assembly 150 may be rotated upward by 90° relative to the top panel 120 and then snap-fitted to the first connecting portion 122. When the foldable storage box 100 is in the folded state, the door panel assembly 150 is accommodated in the second storage space 115. Due to the connection between the door panel assembly 150 and the first connecting portion 122, the door panel assembly 150 can be prevented from rotating or falling downward during or after the folding process. It should be noted that the connection positions of the first connecting portion 122 with the top panel 120 and the door panel assembly 150 are staggered to ensure that the connection between the door panel assembly 150 and the first connecting portion 122 can prevent the door panel assembly 150 from rotating relative to the top panel 120.

The back panel 160 is pivotally connected to the top panel 120. During use of the foldable storage box 100, the back panel 160 can be rotated relative to the top panel 120 to a second position. At the second position, the bottom end of the back panel 160 is proximal to the top panel 120, and the back panel 160 is connected to the second connecting portion 124. This allows the back panel 160 to be accommodated within the second storage space 115 when the foldable storage box 100 is in the folded state. The connection between the back panel 160 and the second connecting portion 124 can prevent the back panel 160 from rotating or falling downward relative to the top panel 120 during or after the folding process. It should be noted that the connection positions of the second connecting portion 124 with the top panel 120 and the back panel 160 are staggered to ensure that the connection between the back panel 160 and the second connecting portion 124 can prevent the back panel 160 from rotating relative to the top panel 120.

Figure 4:
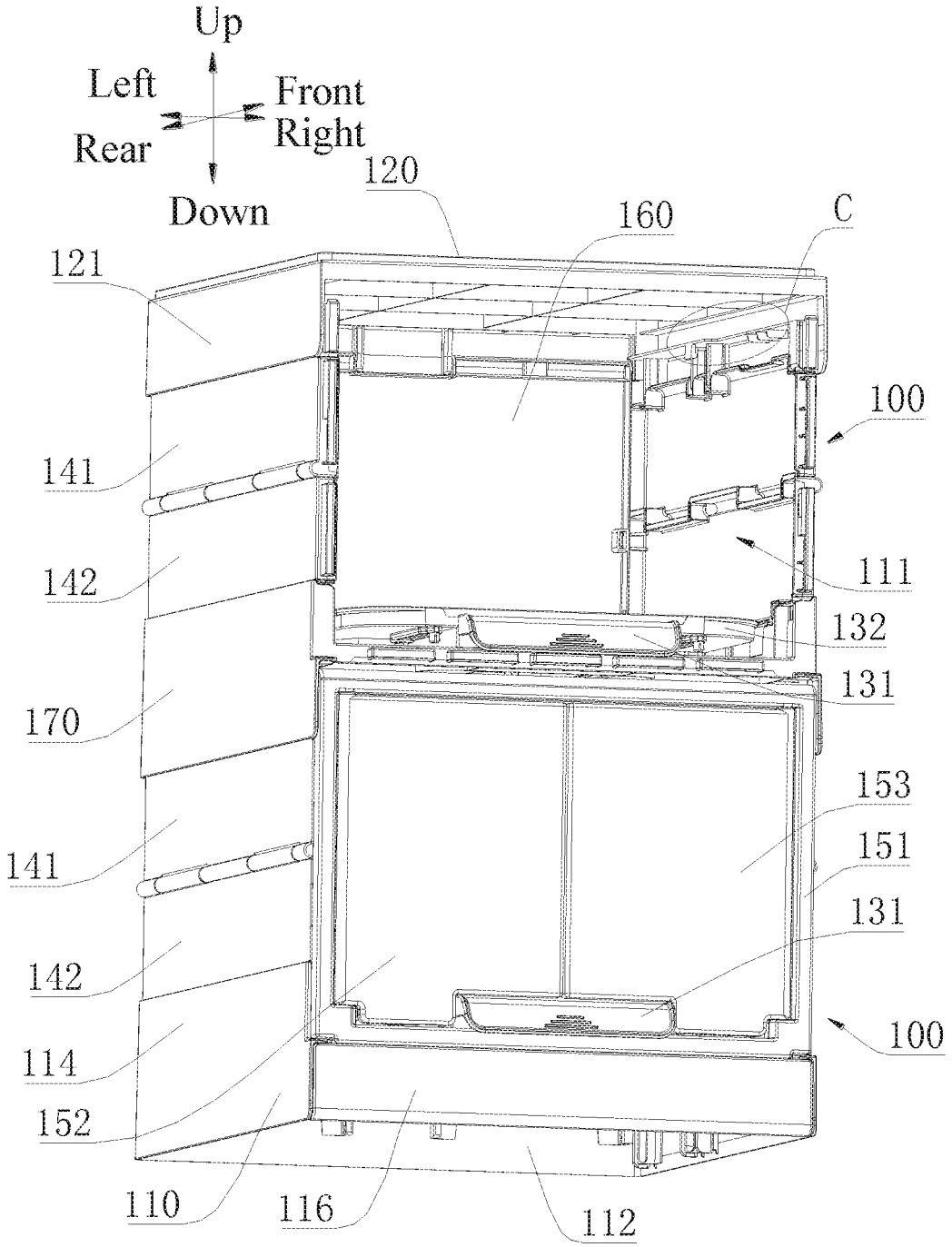
FIG. 4 is a first schematic structural view of a box set according to an embodiment of the disclosure.
Figure 5:
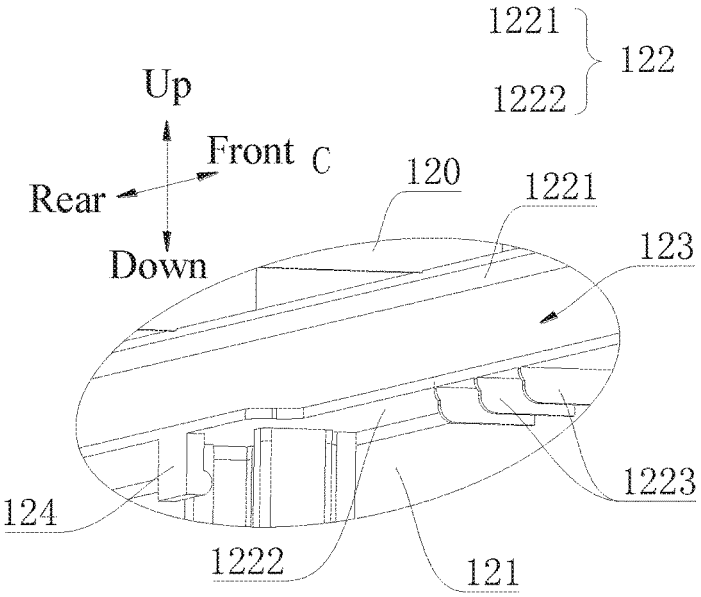
FIG. 5 is a partially enlarged view of the portion C in FIG. 4.

Referring to FIGS. 4 and 5, the first connecting portion 122 is provided with a fixing groove 123 that extends in the front-rear direction. When the foldable storage box 100 is in the folded state, the door panel assembly 150 is located in the fixing groove 123. Specifically, the upper end of the door panel assembly 150 is pivotally connected to the top panel 120, and the top panel 120 and the door panel assembly 150 are connected at a position corresponding to the end of the fixing groove 123 that is away from the storage space 111. When the door panel assembly 150 is being folded, first it can be flipped upward relative to the top panel 120 to a third position, such that the door panel assembly 150 is outside the first storage space 111 and parallel to the fixing groove 123. Then, the door panel assembly 150 can be pushed to slide along the fixing groove 123 into the first storage space 111, such that the left and right side edges of the door panel assembly 150 are inserted into the fixing groove 123. Hence, the fixing groove 123 can support the door panel assembly 150 and limit its position in the up-down direction.

Figure 13:
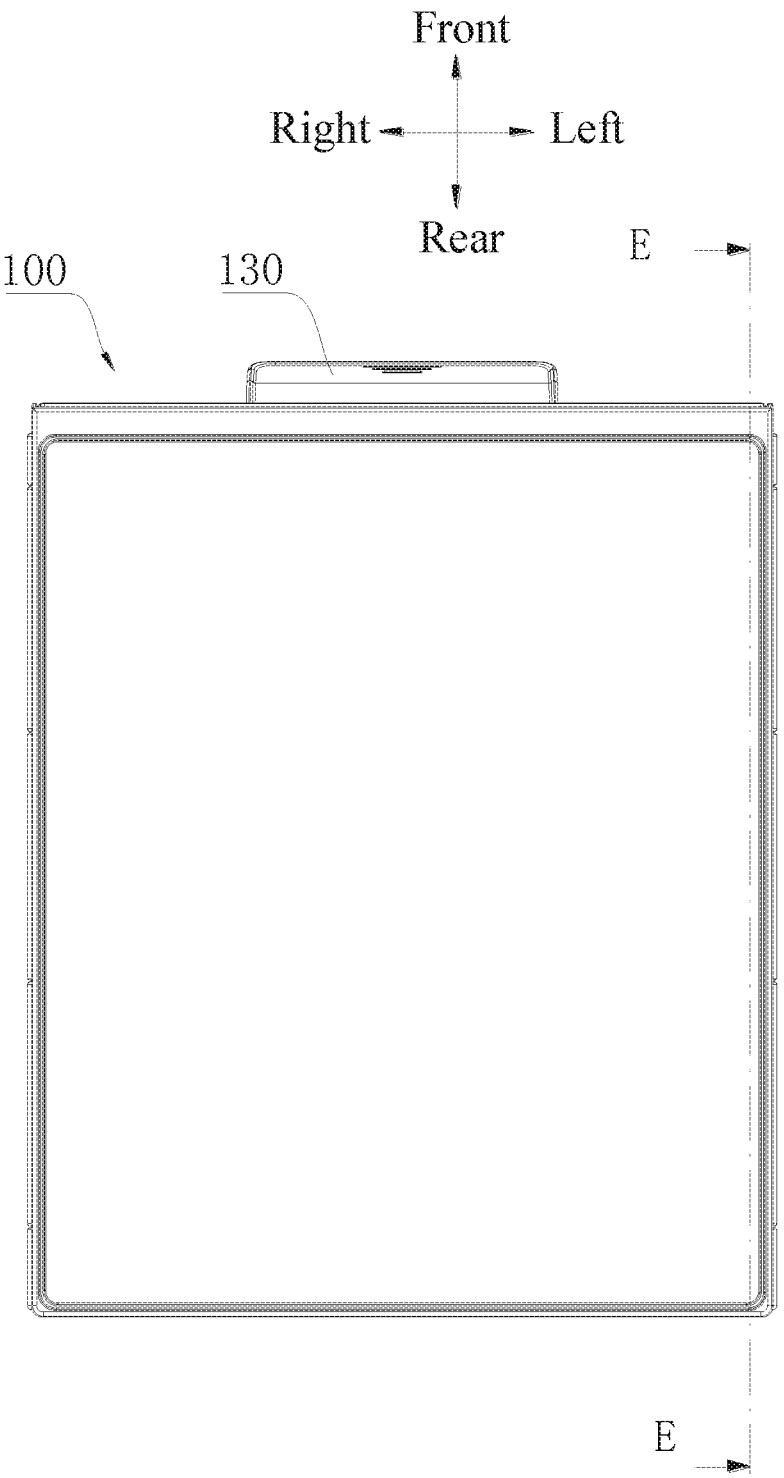
FIG. 13 is a top view of a foldable storage box according to an embodiment of the disclosure.
Figure 14:
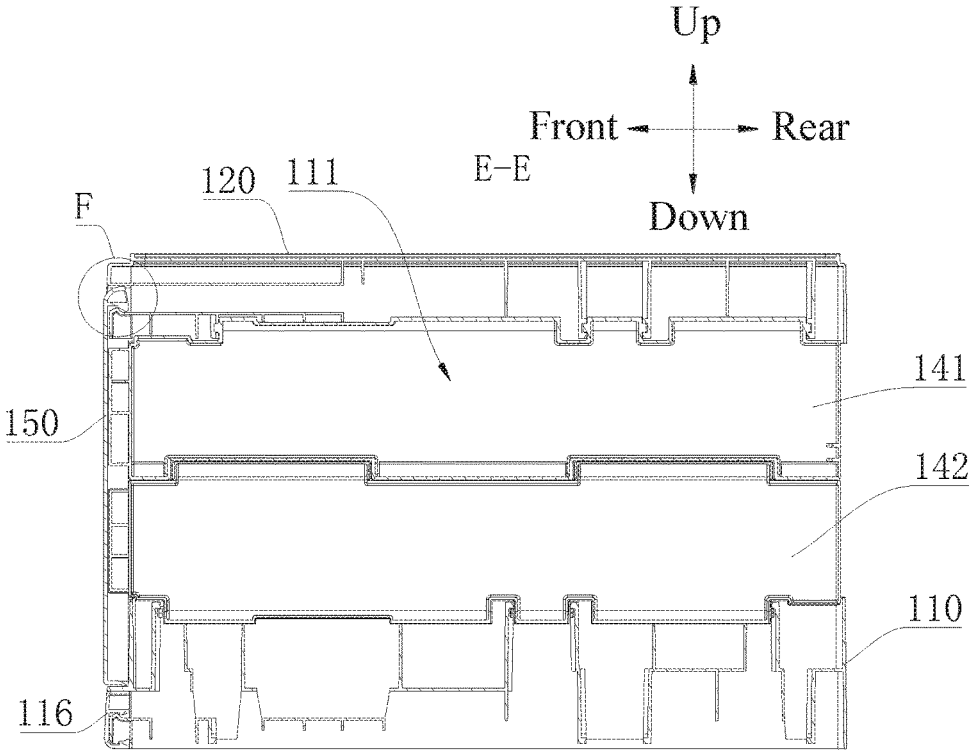
FIG. 14 is a cross-sectional view of a foldable storage box of FIG. 13, taken at E-E.
Figure 15:
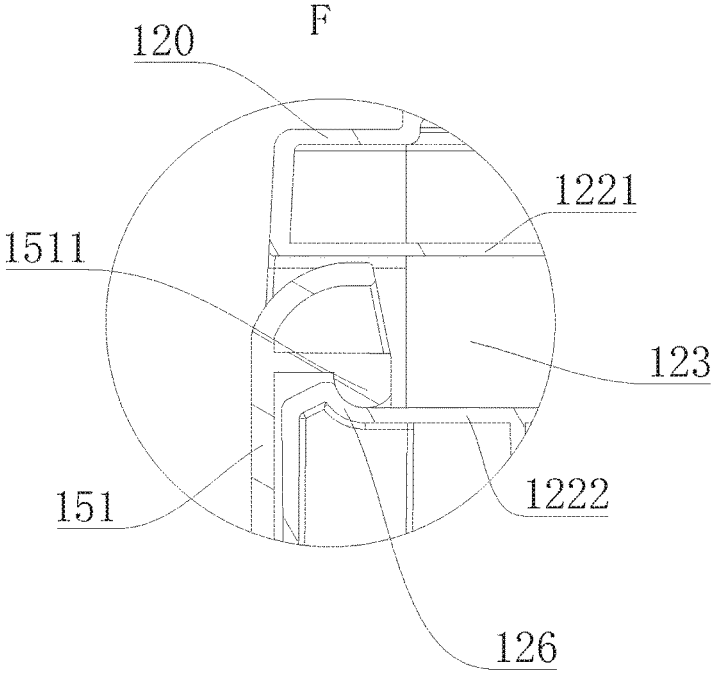
FIG. 15 is a partially enlarged view of the portion F in FIG. 14.

Referring to FIGS. 13-15, in some embodiments, the fixing groove 123 is provided at its front end with a snap-fit element 126. The side of the snap-fit element 126 facing the first storage space 111 is provided with an arc-shaped surface, which smoothly merges with the lower side wall of the fixing groove 123. The door frame 151 is provided at its upper end with a connecting head 1511 that is semi-circular shaped, and the side of the door frame 151 that faces the first storage space 111 is provided with a groove extending in the up-down direction. When the foldable storage box 100 is in the unfolded state, the connecting head 1511 is snap-fitted with the snap-fit element 126 and fitted to the arc-shaped surface of the snap-fit element 126. When the door panel assembly 150 flips upward, the connecting head 1511 rotates along the arc-shaped surface until the door panel assembly 150 is parallel to the fixing groove 123 and thus can be pushed into the first storage space 111. During the sliding of the door panel assembly 150 along the fixing groove 123, the door frame 151 slides along the fixing groove 123. Moreover, the snap-fit element 126 is embedded in the groove of the door frame 151 and moves relative to it, thereby limiting the position of the door frame 151.

Referring to FIG. 4, in some embodiments of the disclosure, the top panel 120 is provided at its underside with a first surrounding panel 121. The first surrounding panel 121 extends along the perimeter of the top panel 120. The first connecting portion 122 is located on the inner side of the first surrounding panel 121. When the foldable storage box 100 is in the folded state, the first surrounding panel 121 forms at least a part of the side wall of the second storage space 115. Specifically, the first surrounding panel 121 has a certain height. After the foldable storage box 100 is folded, the first surrounding panel 121 is positioned between the top panel 120 and the bottom panel 110 and abuts against the bottom panel 110. It forms the second storage space 115 between the top panel 120 and the bottom panel 110, configured to accommodate the side panel assemblies 140, the door panel assembly 150, and the back panel 160. The side of the first surrounding panel 121 that faces the first storage space 111 or the second storage space 115 is its inner side. Referring to FIG. 5, the first connecting portion 122 includes an upper rib plate 1221 and a lower rib plate 1222 that are spaced apart in the up-down direction. Both the upper rib plate 1221 and the lower rib plate 1222 are located on the side of the first surrounding panel 121 that faces the storage space 111, and the fixing groove 123 is formed between the upper rib plate 1221 and the lower rib plate 1222. To enhance the support strength of the first connecting portion 122, the lower rib plate 1222 is provided at its underside with at least one reinforcing rib 1223. In some embodiments, two first connecting portions 122 are provided, which are respectively located on the first surrounding panels 121 on the left and right sides of the top panel 120.

Referring to FIGS. 2 and 3, in some embodiments, the side of the bottom panel 110 that faces the top panel 120 is provided with a second surrounding panel 114. The second surrounding panel 114 extends along the perimeter of the bottom panel 110. When the foldable storage box 100 is in the folded state, the first surrounding panel 121 abuts against the second surrounding panel 114, to form the second storage space 115 between the top panel 120 and the bottom panel 110, with the first surrounding panel 121 and the second surrounding panel 114 forming the side walls of the second storage space 115. In some embodiments, the second connecting portion 124 may also be provided with the fixing groove 123. After the back panel 160 is flipped to the second position, it can slide along the fixing groove 123 for storage. The specific structure of the second connecting portion 124 can refer to that of the first connecting portion 122, and will not be described here.

In some embodiments of the disclosure, the door panel assembly 150 includes the door frame 151, the first door panel 152, and the second door panel 153. The door frame 151 is pivotally connected to the top panel 120. The first door panel 152 and the second door panel 153 are arranged in the door frame 151 along the left-right direction. Both the first door panel 152 and the second door panel 153 are pivotally connected to the door frame 151, with both the rotation axis of the first door panel 152 relative to the door frame 151 and the rotation axis of the second door panel 153 relative to the door frame 151 extending in the up-down direction. When the foldable storage box 100 is unfolded for normal use, the first door panel 152 and the second door panel 153 are pivotable relative to the door frame 151 to open the foldable storage box 100, and the drawable panel 130 is moveable along the front-rear direction between the first door panel 152 and the second door panel 153. When the foldable storage box 100 is folded, both the first door panel 152 and the second door panel 153 are rotated into the door frame 151, and the door frame 151 flips upward relative to the top panel 120 such that the door panel assembly 150 is rotated to the first position. In some embodiments, the positions of the first door panel 152 and the second door panel 153 can be limited, preventing them from rotating downward after the door panel assembly 150 is rotated to the first position. For example, the side of the door frame 151 that faces the storage space 111 may be provided with a position-limiting protruding portion to block the first door panel 152 and the second door panel 153. Alternatively, damping rings may be arranged at the joints between the first and second door panel 152, 153 and the door frame 151, to increase the rotational resistance of the first and second door panel 152, 153. Referring to FIG. 1, when the first door panel 152 and the second door panel 153 are received in the door frame 151, they block the door frame 151 to separate the storage space 111 from the exterior of the foldable storage box 100. At this moment, a through-hole is formed between the first door panel 152 and the second door panel 153, and the handle 131 of the drawable panel 130 extends out of the storage space 111 through the through-hole.

Figure 10:
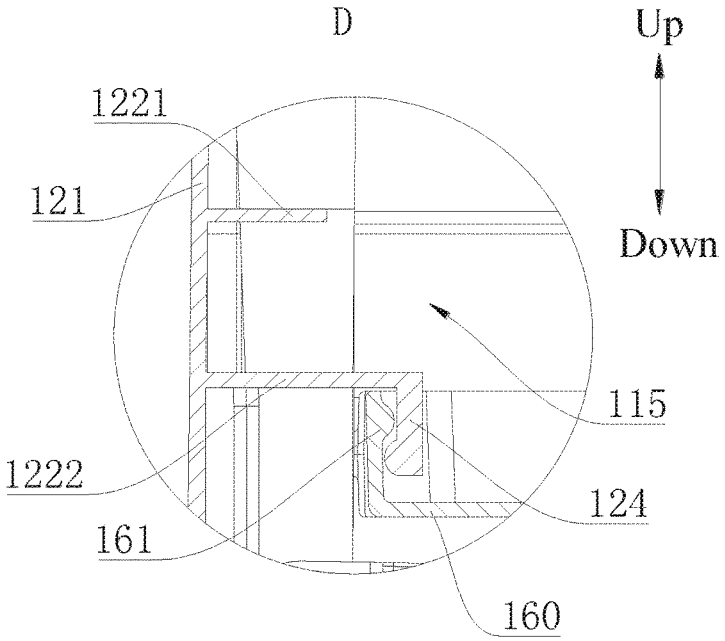
FIG. 10 is a partially enlarged view of the portion D in FIG. 9.

Referring to FIGS. 7-10, in some embodiments of the disclosure, the back panel 160 is provided with a third connecting portion 161. When the foldable storage box 100 is in the folded state, the third connecting portion 161 is connected to the second connecting portion 124. Specifically, the top end of the back panel 160 is pivotally connected to the top panel 120, and the back panel 160 flips upward relative to the top panel 120 to the second position, such that the back panel 160 is located beneath the top panel 120, and the second connecting portion 124 is connected to the third connecting portion 161. In some embodiments, the second connecting portion 124 and the third connecting portion 161 are connected by a snap-fit. Referring to FIG. 10, for example, both the second connecting portion 124 and the third connecting portion 161 have a snap-fit structure, and each of them is provided at an end with a protrusion. After the back panel 160 is rotated to the second position, the protrusion of the second connecting portion 124 and the protrusion of the third connecting portion 161 correspond to each other and can be snap-fitted with each other. Apparently, the structures of the second connecting portion 124 and the third connecting portion 161 are not limited to this configuration. For example, one of the second connecting portion 124 and the third connecting portion 161 may be a through-hole, and the other may be a connecting pin having an elastically deformable end. The end of the connecting pin may elastically deform and pass through the through-hole to achieve connection.

Referring to FIG. 10, in some embodiments of the disclosure, the second connecting portion 124 is located on the first surrounding panel 121 and positioned on the inner side of the first surrounding panel 121, to avoid interference with items inside the storage space 111 and avoid contact when the user's hand reaches into the storage space 111. In this way, it enhances safety.

In some embodiments of the disclosure, the first connecting portion 122 and the second connecting portion 124 are staggered along the up-down direction. Thus, when the foldable storage box 100 is in the folded state, the door panel assembly 150 and the back panel 160 are staggered along the up-down direction, avoiding interference therebetween. For example, referring to FIGS. 5 and 10, the second connecting portion 124 is located on the underside of the lower rib plate 1222 of the first connecting portion 122. When the foldable storage box 100 is in the folded state, the door panel assembly 150 is positioned above the back panel 160, avoiding interference therebetween.

Figure 8:
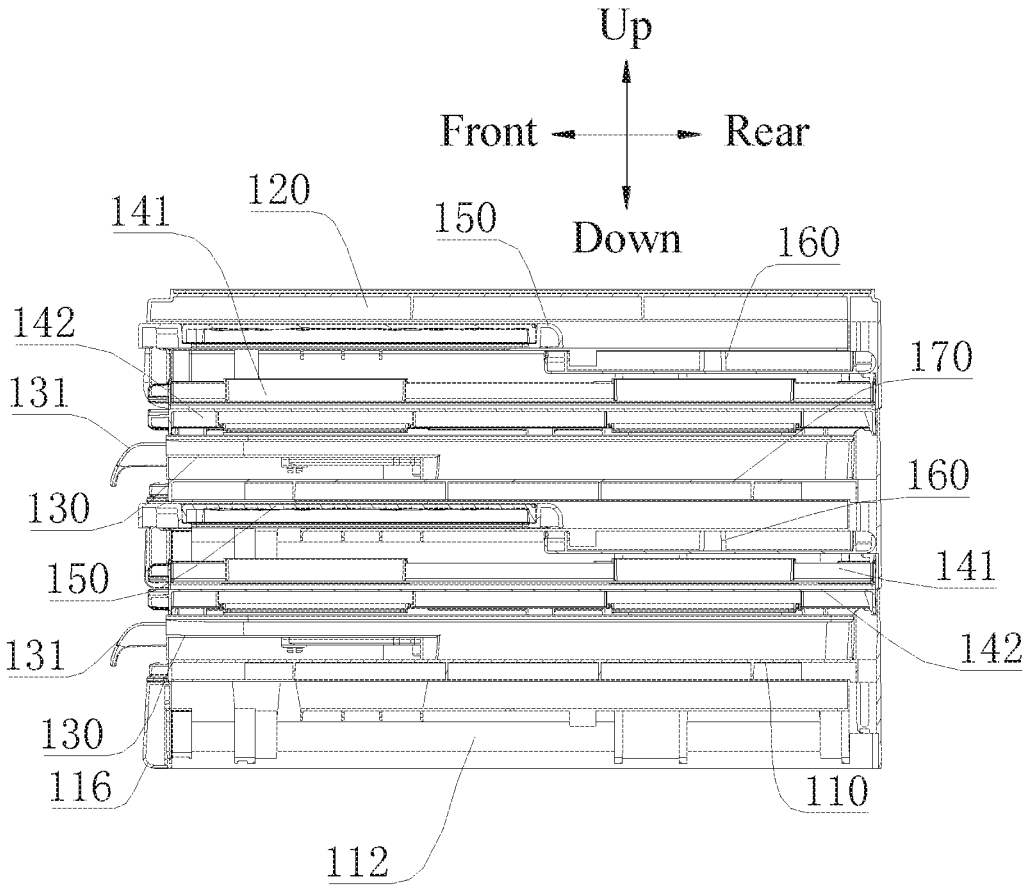
FIG. 8 is a cross-sectional view of a box set of FIG. 7, taken at A-A.
Figure 9:
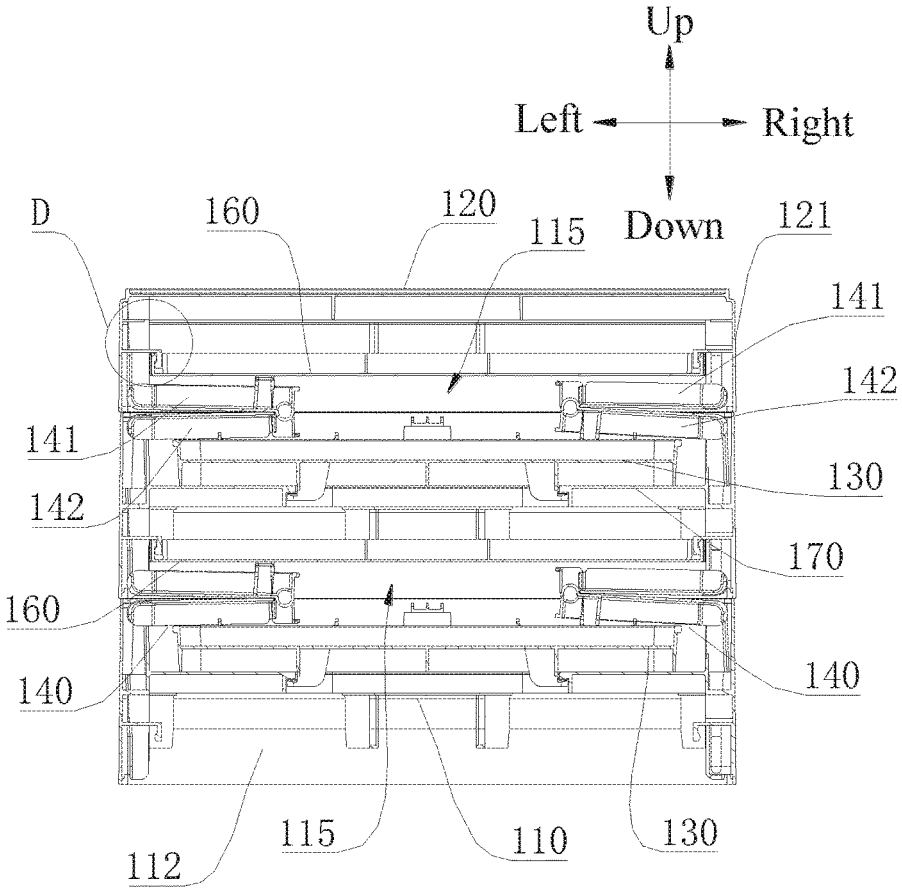
FIG. 9 is a cross-sectional view of a box set of FIG. 7, taken at B-B.
Figure 12:
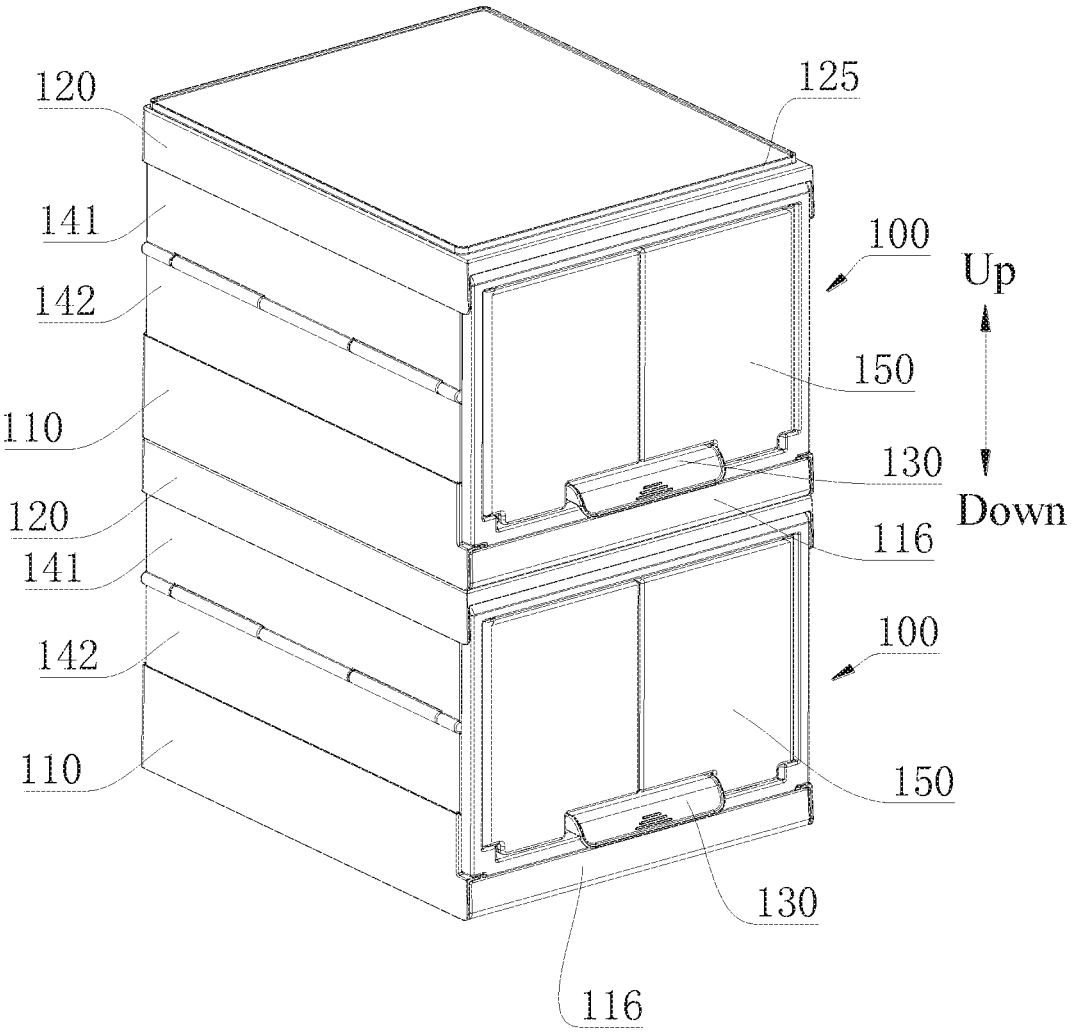
FIG. 12 is a schematic structural view illustrating two foldable storage boxes according to an embodiment of the disclosure stacked one above the other.

Referring to FIGS. 1 and 3, in some embodiments of the disclosure, either the top side of the top panel 120 or the underside of the bottom panel 110 is provided with a limiting protrusion 125, and the other is provided with a limiting groove 112 that matches the limiting protrusion 125. Referring to FIG. 12, when two or more foldable storage boxes 100 are stacked one above the other, among the two foldable storage boxes 100, the limiting protrusion 125 of the foldable storage box 100 at the lower position is fitted into the limiting groove 112 of the foldable storage box 100 at the upper position, thereby limiting the horizontal position of the adjacent two foldable storage boxes 100 and enhancing stability. Referring to FIGS. 4 and 8, in some embodiments, the foldable storage box 100 further includes a blocking bar 116 connected to the front sidewall of the bottom panel 110. It covers the gap caused by an excessively high front sidewall of the bottom panel 110, resulting in a neat and aesthetically pleasing appearance for the foldable storage box 100.

Referring to FIGS. 4 and 6, the box set according to the embodiment of the disclosure includes at least two foldable storage boxes 100 stacked one above the other as mentioned above. Any two adjacent foldable storage boxes 100 may be referred to as the first foldable storage box and the second foldable storage box, respectively. The bottom panel 110 of the first foldable storage box and the top panel 120 of the second foldable storage box are integrally formed to create the connecting panel 170. The underside of the connecting panel 170 forms the top wall of the first storage space 111 and the second storage space 115 of the second foldable storage box, and the top side of the connecting panel 170 forms the bottom wall of the first storage space 111 and the second storage space 115 of the first foldable storage box. On one hand, it ensures a more secure connection between several foldable storage boxes 100. On the other hand, during folding for storage or unfolding for use, it allows for simultaneous operation of several foldable storage boxes 100 to save time. In some embodiments, the top side of the top panel 120 of the foldable storage box 100 at the top of the box set is provided with the limiting protrusion 125, and the underside of the bottom panel 110 of the foldable storage box 100 at the bottom of the box set is provided with the limiting groove 112, providing position limiting during stacking of the box set with other box sets or another single foldable storage box 100.

The working process of the disclosure is as follows.

In order to fold the foldable storage box 100 for storage, the drawable panel 130 can be pushed into the first storage space 111. The door panel assembly 150 can be flipped upward to the first position and then pushed along the fixing groove 123 until the door panel assembly 150 is disposed between the bottom panel 110 and the top panel 120. The back panel 160 can be flipped upward to the second position, such that the back panel 160 is disposed between the bottom panel 110 and the top panel 120 and the third connecting portion 161 is connected to the second connecting portion 124, thereby securing the back panel 160. Subsequently, the first sub-panel 141 and the second sub-panel 142 of the side panel assembly 140 can be respectively rotated to positions between the bottom panel 110 and the top panel 120. The first sub-panel 141 and the second sub-panel 142 are rotated relative to each other, allowing the side panel assembly 140 to be folded and disposed between the bottom panel 110 and the top panel 120. The top panel 120 and the bottom panel 110 move closer to each other, with the first surrounding panel 121 and the second surrounding panel 114 abutting against each other. In such a case, the second storage space 115 is created between the bottom panel 110 and the top panel 120, and the height of the foldable storage box 100 is reduced, facilitating storage and transportation.

In order to unfold the foldable storage box 100 for use, the first sub-panel 141 and the second sub-panel 142 can be rotated outward to unfold the side panel assembly 140, with the top panel 120 and the bottom panel 110 moving away from each other. Then, the second connecting portion 124 can be detached from the third connecting portion 161, and the back panel 160 can be flipped downward so that its bottom end abuts against the bottom panel 110. The door panel assembly 150 can be pulled out of the fixing groove 123 and flipped downward so that its bottom end abuts against the bottom panel 110, providing support for the top panel 120 and the bottom panel 110. It should be emphasized that, since the door panel assembly 150 is connected to the first connecting portion 122 and the third connecting portion 161 is connected to the second connecting portion 124, the door panel assembly 150 and the back panel 160 can be securely connected to the top panel 120 when they are accommodated in the storage space 111. It can prevent the door panel assembly 150 or the back panel 160 from flipping downward, avoid interfering with the user's folding or unfolding operations, and prevent the door panel assembly 150, the back panel 160, the side panel assembly 140, and the drawable panel 130 from being squeezed.

The unfolding and folding processes of the box set can refer to the operation process of the individual foldable storage box 100 mentioned above. During the operation of the box set, the top panel 120 and the bottom panel 110 of several foldable storage boxes 100 can be simultaneously pressed or pulled to move closer or farther apart.

In summary, the foldable storage box 100 and the box set according to the embodiments of this disclosure offer more convenient folding and unfolding operations. Moreover, since no components need to be disassembled, the risk of component loss during storage and transportation and thus the failure of the foldable storage box 100 can be significantly reduced. In addition, due to the arrangement of the first connecting portion 122 and the second connecting portion 124, the door panel assembly 150 and the back panel 160 can be securely connected to the top panel 120 when they are accommodated in the storage space 111, preventing the door panel assembly 150 or the back panel 160 from flipping downward accidently, avoid interfering with the user's folding or unfolding operations, and prevent the door panel assembly 150, the back panel 160, the side panel assembly 140, and the drawable panel 130 from being squeezed.

In the end, it should be explained that the forgoing embodiments are provided for purposes of illustration only and are not intended to limit the scope of the disclosure. It should be noted that those skilled in the art may derive modifications and equivalents without departing from the technical principle of the disclosure. The disclosure is intended to cover all such modifications and equivalents.

The invention claimed is:

1. A foldable storage box having an unfolded state and a folded state, wherein the foldable storage box comprises:

a bottom panel and a top panel;

a drawable panel arranged on a side of the bottom panel facing the top panel, wherein the drawable panel is connected to the bottom panel and is movable in a front-rear direction relative to the bottom panel;

at least two side panel assemblies, each of which has a top end pivotally connected to the top panel and a bottom end pivotally connected to the bottom panel, and is foldable in such a manner that the top end and the bottom end thereof get closer to each other;

a door panel assembly pivotally connected to the top panel, and a back panel pivotally connected to the top panel, wherein the side panel assembly, the door panel assembly, and the back panel extends along a perimeter of the top panel;

wherein, in the unfolded state, the door panel assembly and the back panel respectively abut against the bottom panel to support the top panel, a first storage space is formed between the top panel and the bottom panel, and the side panel assemblies, the door panel assembly, and the back panel constitute sidewalls of the first storage space; and in the folded state, the top panel abuts on the bottom panel, a second storage space is formed between the top panel and the bottom panel, the side panel assemblies are rotated into the second storage space and folded therein, and the door panel assembly and the back panel are respectively rotated into the second storage space.

2. The foldable storage box according to claim 1, wherein an underside of the top panel is provided with a first connecting portion and a second connecting portion; and in the folded state, the door panel assembly is connected to the first connecting portion to limit a position of the door panel assembly in an up-down direction, and the back panel is connected to the second connecting portion to limit a position of the back panel in the up-down direction.

3. The foldable storage box according to claim 2, wherein the first connecting portion is provided with a fixing groove that extends in the front-rear direction, and, in the folded state, the door panel assembly is located in the fixing groove.

4. The foldable storage box according to claim 3, wherein the underside of the top panel is provided with a first surrounding panel extending along the perimeter of the top panel, the first connecting portion is located on an inner side of the first surrounding panel, and, in the folded state, the first surrounding panel at least forms a portion of a side wall of the second storage space.

5. A box set, comprising:

at least two foldable storage boxes according to claim 4, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

6. A box set, comprising:

at least two foldable storage boxes according to claim 3, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

7. The foldable storage box according to claim 2, wherein the back panel is provided with a third connecting portion, and, in the folded state, the third connecting portion is connected to the second connecting portion.

8. A box set, comprising:

at least two foldable storage boxes according to claim 7, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

9. The foldable storage box according to claim 2, wherein the first connecting portion and the second connecting portion are staggered along the up-down direction, such that the door panel assembly and the back panel are staggered along the up-down direction in the folded state.

10. A box set, comprising:

at least two foldable storage boxes according to claim 9, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

11. A box set, comprising:

at least two foldable storage boxes according to claim 2, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

12. The foldable storage box according to claim 1, wherein the side panel assemblies each comprises at least two sub-panels that are sequentially pivotally connected, one of which at a top end is a first sub-panel pivotally connected to the top panel, and one of which at a bottom end is a second sub-panel pivotally connected to the bottom panel; and, in the folded state, both the first sub-panel and the second sub-panel are pivotable into the second storage space.

13. A box set, comprising:

at least two foldable storage boxes according to claim 12, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

14. The foldable storage box according to claim 1, wherein the door panel assembly comprises a door frame, a first door panel, and a second door panel, wherein the door frame is pivotally connected to the top panel, the first door panel and the second door panel are arranged in the door frame along a left-right direction, both the first door panel and the second door panel are pivotally connected to the door frame, with both a rotation axis of the first door panel relative to the door frame and a rotation axis of the second door panel relative to the door frame extending in an up-down direction.

15. A box set, comprising:

at least two foldable storage boxes according to claim 14, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

16. The foldable storage box according to claim 1, wherein one of a top side of the top panel and an underside of the bottom panel is provided with a limiting protrusion, the other one is provided with a limiting groove, and the limiting protrusion fits with the limiting groove.

17. A box set, comprising:

at least two foldable storage boxes according to claim 16, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

18. A box set, comprising:

at least two foldable storage boxes according to claim 1, which are stacked on top of each other, wherein, among a first foldable storage box and a second foldable storage box which are adjacent to each other, of the at least two foldable storage boxes, a bottom panel of the first foldable storage box and a top panel of the second foldable storage box are integrally formed to create a connecting panel, an underside of the connecting panel forms a top wall of the first storage space and the second storage space of the second foldable storage box, and a top side of the connecting panel forms a bottom wall of the first storage space and the second storage space of the first foldable storage box.

* * * * *